US006223653B1

(12) United States Patent
Christ

(10) Patent No.: US 6,223,653 B1
(45) Date of Patent: May 1, 2001

(54) SCREEN PRINTING APPARATUS

(75) Inventor: Alois Christ, Wiesbaden (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/564,749

(22) Filed: May 4, 2000

(30) Foreign Application Priority Data

May 7, 1999 (DE) ..... 199 21 306

(51) Int. Cl.[7] ..... B41F 17/08
(52) U.S. Cl. ..... 101/38.1; 101/124; 101/127.1
(58) Field of Search ..... 101/38.1, 39, 40, 101/40.1, 123, 124, 127.1, 128

(56) References Cited

U.S. PATENT DOCUMENTS

| | | | | |
|---|---|---|---|---|
| 2,244,272 | * | 6/1941 | Vollstorf | 101/115 |
| 2,261,255 | * | 11/1941 | Jackson | 101/124 |
| 2,304,725 | * | 12/1942 | Bauman | 101/115 |
| 3,540,371 | * | 11/1970 | Rudolph et al. | 101/38 |
| 4,750,419 | * | 6/1988 | Meredith | 101/40 |
| 5,317,967 | * | 6/1994 | Heidenreich | 101/38.1 |
| 5,651,308 | | 7/1997 | Rothwetter et at. . | |

FOREIGN PATENT DOCUMENTS

| | | |
|---|---|---|
| 898 746 | 12/1953 | (DE) . |
| 44 36 275 A1 | 4/1996 | (DE) . |
| 0 700 781 A2 | 3/1996 | (EP) . |

* cited by examiner

*Primary Examiner*—Ren Yan
(74) *Attorney, Agent, or Firm*—Michael J. Striker

(57) ABSTRACT

In a screen printing apparatus for printing a conical object rotatable about a rotation axis (4) by means of a screen member (2) which must perform a circular motion about the cone intersection point (6) of the conical object, this circular motion is reproduced by means of three linear drive devices (14,22) and 24). A first linear drive device (14) produces a translational motion of a U-shaped frame (10), in which the screen member holder (8) is held, in a direction transverse to the rotation axis (4) of the object to be printed. The additional drive devices (22,24) act to superimpose both a translational motion transverse to that of the first linear drive device (14) and a rotary motion of the screen member (2) about its center point (38). The first linear drive (14) and the additional linear drive devices (22,24) are numerically controllable by a computer, in which a predetermined motion course for the screen member is stored. This structure avoids the necessity of providing a means for rotation axle at the pivot point (6) and thus reduces the structural expense and space required for the apparatus. At the same time the apparatus can be used for printing cylindrical objects using exclusively the first linear drive device.

9 Claims, 1 Drawing Sheet

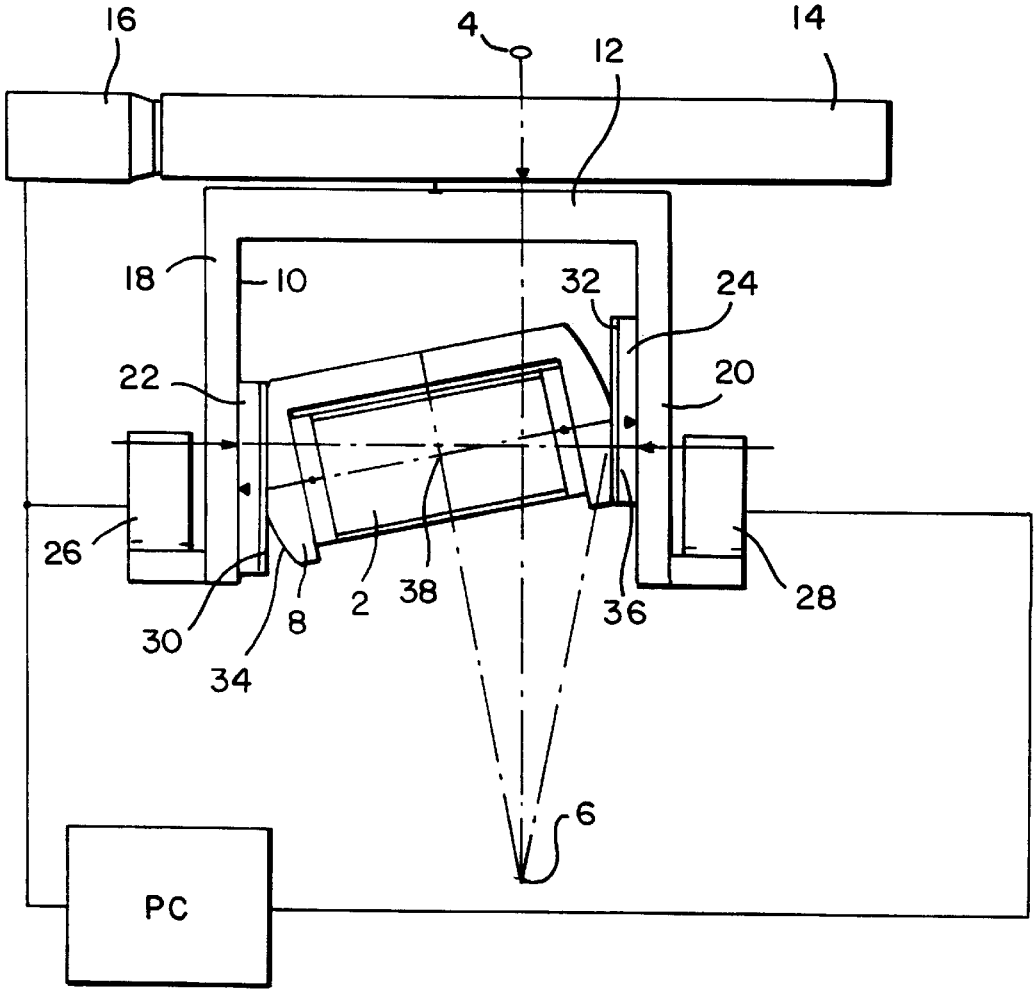
16
4
12
14
18
10
32
24
22
20
26
30
34
8
2
38
36
28
6
PC

SCREEN PRINTING APPARATUS

BACKGROUND OF THE INVENTION

1. Field of the Invention

The present invention relates to a screen printing apparatus and, more particularly, to a screen printing apparatus comprising means for rotatably mounting an article to be printed; an approximately planar screen member provided with an open mesh and a printing pattern; ink feeding devices and wiper driving devices for conveying printing inks through the screen member onto the article to be printed; a screen member holder for the approximately planar screen member and drive means for the screen member holder for producing a rolling motion of the screen member in a plane on the article during an essentially slip-free contact of the screen member with the article along a surface line of the article. Particularly the invention relates to an improved drive mechanism for the screen member in this screen printing apparatus.

2. Prior Art

The screen printing process has been used, for the application of printed images on the outside of containers, especially glass bottles. In the case of glass bottles especially screen printing inks are used, for example, which are baked on after their application to the glass surface in a thermal after-treatment and in this way are bonded with the substance of the glass in a practically undetachable manner.

In the predominant number of applications the containers have a rotationally symmetric form. The simplest form possible for a container with a wall is a hollow cylinder. Those containers with a cylindrical outer surface may be printed most easily with the screen printing methods. The container is clamped so that is rotatable about its cylinder axis, which is usually aligned horizontally. The screen member containing the printing pattern moves by contact with the upper outer surface of the container in a tangential direction over the cylinder perpendicular to its rotation axis, whereby by rotation of the container its cylinder surface rolls on the underside of the screen member so that at the same time printing inks are applied on the container through the screen.

In each case the screen member is driven translationally by this rolling motion. The clamped container can be either freely rotating but also may be driven synchronously with the translational motion of the screen member, whereby less slippage and thus a sharper printed image results. One known apparatus for printing a cylindrical object does not require much space, because the screen member is moved only translationally and of course for a distance equal to the cylinder circumference. If the outer wall of the container deviates only slightly from the ideal cylindrical form, for example by a slight conicity or a very slight convexity, the container can still be worked in this way, because the screen of the screen member may generally be pressed by the wiper approximately on the outer surface of the object to be printed. However since the object to be printed in this case no longer has equal peripheral speeds overall and the screen member can only move further with a predetermined speed, the object to be printed has peripheral speeds when its form deviates from a cylindrical form in some regions which are not exactly equal which already effects the sharpness of the printed image for a certain slip.

Conical containers, for example Erlenmeyer flasks, whose conicity is no longer characterized as slight, are frequent application cases. The rolling surface of a conical container with a truncated conical-shaped outer surface on a plane is an annular surface. If on the other hand the container is rotatable about its fixed rotation axis during printing, the container now can no longer roll on the annular surface for printing. Instead the annular surface must roll on the fixed container. This annular surface of part of this annular surface is the screen member. So that the screen member can roll on the article to be printed in a horizontal plane, the article is held in position so that it is rotatable and its rotation axis is inclined about half a cone angle relative to the horizontal, so that the upper surface line of the container, i.e. equivalent to the generatrix, extends horizontally. The screen member must describe a path around a vertical axis, on which the apex of the imaginary extension of the truncated conical-shaped container to be printed lies.

The less the conicity of the container to be printed, the more the rotation axis of the screen member must be spaced from the container to be printed. This means that in the known screen printing apparatus for conical containers, the rotation axis for the screen members must be spaced from the container different distances for containers of different conicity. Built-in lateral supports are thus used for conical containers in the known screen printing apparatus for this reason and are exchangeable in different sizes. These supports have a vertical axis at their end so that the screen member is rotatable about a radius arm in order to be able to perform its annular motion. This requires a considerable storage for exchangeable machine parts and especially requires an at least laterally very large amount of space in the automatic production line. Moreover retooling the production line for containers of different conicity is considerably time consuming.

The above-described method has already been mentioned in German Patent 898 746 from 1953. In this comparatively old prior art patent it already was suggested, especially for printing of bodies with non-cylindrical, e.g. conically-shaped, regions to use a stencil frame in the form of a rotationally symmetric rotating body instead of a planar screen stencil, whose cross-section is the mirror image of a cross-section, which is the exact longitudinal section of the object to be printed along a surface line. This suggestion completely ignores that fact that when contact is made with a non-axially parallel surface line, especially when only one of the bodies rolling on each other is driven, an uncontrollable slipping occurs, which is unacceptable for screen printing with a higher image quality.

SUMMARY OF THE INVENTION

It is an object of the present invention to provide a screen printing apparatus of the above-described kind for providing printing of a higher quality on conical objects, which is more compact than current screen printing apparatus of the same type and which may be rapidly adjusted to print containers of different form and requires no additional exchange of parts for the respective print images apart from the screen member during a change from a container of one form to another.

This object, and others which will be made more apparent hereinafter, are attained in a screen printing apparatus for printing an outer surface of a rotationally symmetric truncated cone shaped object, which comprises means for rotatably mounting an article to be printed so that the article is rotatable about a rotation axis thereof; an approximately planar screen member provided with an open mesh and a printing pattern for the article to be printed; means for conveying printing inks through the open mesh of the screen member onto the article to be printed including ink feeding devices and wiper driving devices; a screen member holder for the approximately planar screen member and drive means for the screen member holder for producing a rolling motion of the screen member in a plane on the article during an essentially slip-free contact of the screen member with the article along a surface line of the article.

According to the invention the drive means comprises a number of individual numerically controllable cooperating drive units for moving the screen member holder in two opposite directions in the plane of the rolling motion and a rotary motion of the screen member holder in the plane of the rolling motion, whereby the screen member performs a pivoting motion about a pivot point spaced from the screen member.

By superimposing several individual motions produced by individual drive devices arranged in the immediate vicinity of the screen member, the rotational motion about a remote rotation center point is produced. This rotational motion about a pivot axis spaced from the screen member is basically composed of translational motions in the rotation plane in two directions and is a rotation motion of the screen member about its own axis. The directions of both translational motions are selected appropriately so that the one translational direction extends tangentially to the rolling object and perpendicular to its rotation axis, as is already known for the case of the single drive device used for the printing of purely cylindrical objects. The direction of the additional translational motion components is appropriately selected to be perpendicular to the translational motion produced by the first drive device. With two drive devices acting perpendicularly to each other of this type the screen member can be moved to a limited extent in all directions in its plane.

It would be possible to produce the rotational motion of the screen member about its own axis by a superposition of exclusively rotational motions of the screen member holder about a perpendicular axis. This embodiment is also part of the present invention.

In a preferred embodiment of the invention this type of rotational drive is however not used. Instead two additional linear drive devices are used to produce the two translational motion components, whose motion direction extends perpendicularly to the direction of the translational motion produced by the first linear drive device, and the rotational motion component. Both these additional linear drive devices engage at different points on the screen member holder, so that different motion courses for these two additional drive devices produces the rotational motion of the screen frame. The screen member holder is appropriately formed in such a manner that it engages the respective additional linear drive devices along two circular arc-shaped segments. This is analogous to the situation in which one holds a table tennis ball between two vertically oriented table tennis paddles and moves the paddles in opposite horizontal directions. If the motion of both paddles is the same then the table tennis ball rotates about its axis between the paddles without moving itself. If the motion of both table tennis paddles is not equal, the table tennis ball shifts or translates in a horizontal direction between the paddles in addition.

The circular arc-shaped engaging segments of the screen member holder are appropriately formed by respective arc-shaped toothed rims, which mesh with corresponding linear toothed rack elements of the two additional linear drive devices. Other motion transmitting means are conceivable. The motion must be transmitted in as slip-free a manner as possible, in order to provide precise printing results.

Since this preferred embodiment of the invention operates with only three linear drive devices without a rotational drive device, drive devices having the same control behavior or properties can be used here in substantially the same way. Recirculating ball and spindle drives, which are driven by respective rotation angle controllable motors, are preferably used as the drive devices. These drive devices are standard. They are specially formed for numerical control by means of a computer.

The desired motion path for the screen member resulting from the action of the three drive devices can be input into a computer controlling the drive devices. This means for controlling the drive devices is known to one skilled in the art.

The arrangement of the three drive devices in the screen printing apparatus according to the invention is such that the first linear drive device is arranged on the bottom side of a U-shaped fork for shifting the entire fork in a direction along this bottom side and the additional drive devices are arranged on the fork arms, which carry the screen member holder between them.

The numerical control can be such that a driven rotational motion of the object to be printed is controlled with it, in order thus to obtain an optimum motion synchronization and an exact motion path for the screen member on the outer surface of the article to be printed.

Only the first linear drive device is needed for printing cylindrical objects. The screen member is held rigidly in its fork. Prior art machines would be equipped for either cylindrical printing or conical printing in contrast to the apparatus of the present invention which can do both.

BRIEF DESCRIPTION OF THE DRAWING

The objects, features and advantages of the invention will now be illustrated in more detail with the aid of the following description of the preferred embodiment, with reference to the accompanying sole figure which is a top plan view of a portion of one embodiment of the screen printing apparatus according to the invention, showing the drive devices.

DESCRIPTION OF THE PREFERRED EMBODIMENT

The preferred embodiment of the screen printing apparatus comprises a screen member 2 shown from above in the sole figure. The screen member 2 is the key element of the screen printing apparatus. A truncated cone-shaped article to be printed would be arranged under the right end of the screen member 2 so that it is rotatable about the rotation axis 4 or so that it can be driven rotatably about the rotation axis 4. In as much as the screen member is arranged in a horizontal plane, the cone-shaped article rotatable about the axis 4 is oriented or aligned so that its horizontal upper surface lines or generatrix lines can be brought in contact with the lower side of the screen member 2. The extended cone surface lines or generatrix lines meet at the intersection point 6. So that the screen member 2 can roll on the article rotating about the rotation axis 4 in the horizontal direction without slipping, it must perform a circular motion about the cone intersection point 6 as a pivot point. For the printing process then the screen member 2 describes a rotary motion about the pivot point 6. Thus it travels over a circular arc shaped path in the printing process.

As shown in the drawing, the screen member 2 is carried by a screen member holder 8. The screen member holder 8 is suspended from a U-shaped frame 10. This U-shaped frame 10 is now attached with its base 12 on a first linear drive device 14, which is fixed and driven by means of a servomotor 16. This first linear drive device 14 is itself formed as a recirculating ball and spindle drive. The U-shaped frame 10 is moved by the linear drive device 14 in the direction of its base 12 by rotation of the servomotor 16, which produces the principle motion component of the screen member 2 during the printing process, namely from left to right.

The screen member holder 8 is held between the arms of the U-shaped frame 10 with its ends by means of two additional linear drive devices 22 and 24, which are powered or driven by two additional servomotors 26 and 28 respectively. As can be seen from the drawing, the respective motion directions of the additional linear drive devices 22 and 24 are at right angles to the linear drive device 14. In the embodiment shown in the drawing the additional linear drive devices 22 and 24 have respective linear toothed rack elements 30 and 32 on their sides facing away from the screen member holder 8. Corresponding circular arc-shaped toothed rim segments 34 and 36 on the respective ends of the screen member holder mesh with these toothed rack elements 30 and 32.

It is easily seen from the figure that the screen member holder 8 of the screen member 2 can be easily displaced or moved in a direction perpendicular to the base 12 of the U-shaped frame 10 during a translational motion of the additional linear drive devices 22 and 24. However the screen member 2 can be rotated about its center point 38 in a horizontal plane when the linear drive devices move in opposite directions. Both these types of motion may be superimposed by appropriate control of the additional linear drive devices 22 and 24. When the toothed rack elements 30 and 32 of the screen frame holder 8 are arranged on a common circular track, the screen frame holder 8 is rotatable about its center point 38 between the linear drive devices 22 and 24 without tilting.

It is also apparent that the apparatus described above can equally be used for printing cylindrical articles, when the screen member 2 is oriented in a fixed parallel relationship to the first linear drive device 14 and is operated only by this drive device during the printing process.

The drawing also shows that during printing of objects of reduced conicity the intersection point 6 and thus the above-mentioned pivot point for the screen member 2 is displaced further toward the outside. Since the rotation about this pivot point does not actually occur with the described apparatus, but is conceptual, the describe apparatus requires no additional parts, with which the actual rotation axis must be set up at the respective intersection point 6. Also the spatial requirements of the apparatus must change for printing of objects with small cone angles.

The screen printing apparatus is also provided with means for conveying printing inks through the open mesh of the screen member onto the article to be printed. The means for conveying the printing devices through the open mesh typically can include well known ink feeding devices and wiper driving devices for a wiper that travels over the screen member 2 during the screen printing process.

The servo motors 16, 26, 28 in the embodiment shown in the drawing are rotation angle controllable electric motors. The apparatus can also include a programmable control unit PC which can be a microprocessor, in which at least one predetermined motion path of the screen member holder 8 is stored. Then the printing process is performed with the motion of the screen member holder 8 under control of the programmable control unit PC.

The disclosure in German Patent Application 199 21 306.2-27 of May 7, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a screen printing apparatus, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A screen printing apparatus for printing an outer surface of a rotationally symmetric substantially truncated-cone shaped object, said screen printing comprising means for rotatably mounting an article to be printed so that the article is rotatable about a rotation axis (4) thereof;

an approximately planar screen member (2) provided with an open mesh and a printing pattern for the article to be printed;

means for conveying printing inks through the open mesh of the screen member onto the article to be printed, said means for conveying comprising ink feeding devices and wiper driving devices;

a screen member holder (8) for receiving the approximately planar screen member (2); and drive means for the screen member holder (8) for producing a rolling motion of the screen member (2) in a plane on the article during an essentially slip-free contact of the screen member (2) with the article along a surface line of the article; wherein said drive means comprises a number of individual numerically controllable cooperating drive units (14, 22, 24) for moving the screen member holder (8) in two opposite directions in the plane of said rolling motion and a rotary motion of the screen member holder (8) in the plane of said rolling motion, whereby the screen member (2) performs a pivoting motion about a pivot point (6) spaced from the screen member (2).

2. The screen printing device as defined in claim 1, further comprising a U-shaped frame (10) in which the screen member holder (8) is mounted and wherein the individual numerically controllable cooperating drive units include a first drive device (14) comprising means for performing a translational motion of the screen member holder (8) transverse to the rotation axis (4) of the article to be printed and at least one additional drive device (22,24) for performing another translational motion of the screen member holder (8) at right angles to the translational motion produced by the first drive device.

3. The screen printing device as defined in claim 2, wherein the first drive device (14) is a linear drive device comprising means for moving the U-shaped frame (10) carrying the screen member holder (8) transverse to the rotation axis (4) of the article to be printed.

4. The screen printing device as defined in claim 2, wherein the first drive device (14) is a linear drive device, said at least one additional drive device (22,24) consists of two additional linear drive devices mounted on said U-shaped frame opposite each other, the screen member holder (8) is engaged between the two additional linear drive devices and the respective additional linear drive devices move the U-shaped frame (10) in corresponding motion directions perpendicular to a motion direction of the U-shaped frame by the first drive device.

5. The screen printing apparatus as defined in claim 4, wherein the screen member holder (8) has two circular arc-shaped segments (34, 36) of equal radius and is formed for engagement with said additional linear drive devices, said two additional linear drive devices are operable independently of each other to produce a rotary motion of the screen member holder (8) when the two additional linear drive devices are driven in different motion courses.

6. The screen printing apparatus as defined in claim 5, wherein the two circular arc-shaped segments (34, 36) are toothed rims, which engage with respective linear toothed rack elements (30,32) on the corresponding two additional linear drive devices.

7. The screen printing apparatus as defined in claim 4, wherein the linear drive devices are recirculating ball and spindle drive devices.

8. The screen printing apparatus as defined in claim 2, wherein the first drive device and the at least one additional drive device are recirculating ball and spindle drive devices.

9. The screen printing apparatus as defined in claim 1, wherein the individual drive units are provided with rotation-angle controllable electric motors (16,26,28) and further comprising a programmable numerical control device (PC) for controlling the electric motors and at least one predetermined motion path for said screen member holder (8) stored in the control device (PC).

* * * * *